US008127681B2

(12) United States Patent
Fink

(10) Patent No.: US 8,127,681 B2
(45) **Date of Patent: *Mar. 6, 2012**

(54) METAL-SEALING MATERIAL-FEEDTHROUGH AND UTILIZATION OF THE METAL-SEALING MATERIAL FEEDTHROUGH WITH AN AIRBAG, A BELT TENSIONING DEVICE, AND AN IGNITION DEVICE

(75) Inventor: Thomas Fink, Landshut (DE)

(73) Assignee: Schott AG, Mainz (DE)

( * ) Notice: Subject to any disclaimer, the term of this patent is extended or adjusted under 35 U.S.C. 154(b) by 0 days.

This patent is subject to a terminal disclaimer.

(21) Appl. No.: 11/627,173

(22) Filed: Jan. 25, 2007

(65) Prior Publication Data

US 2007/0187934 A1 Aug. 16, 2007

(30) Foreign Application Priority Data

Jan. 27, 2006 (DE) ..... 10 2006 004 036

(51) Int. Cl.
*F42B 3/12* (2006.01)

(52) U.S. Cl. ..... 102/202.9; 102/202.5; 102/202.12; 174/152 GM

(58) Field of Classification Search ..... 102/202.12, 102/202.9, 202.5, 202.7, 202.8, 202.14; 174/50.52, 174/152 GM See application file for complete search history.

(56) References Cited

U.S. PATENT DOCUMENTS 3,134,329 A 5/1964 Zeman ..... 102/28
3,274,937 A 9/1966 Kyle ..... 102/70.2
3,635,067 A 1/1972 Hanas
3,854,827 A * 12/1974 Merz et al. ..... 403/29
3,971,320 A 7/1976 Lee ..... 2/28 R
5,016,461 A 5/1991 Walker et al.
5,345,872 A 9/1994 Takahashi et al. ..... 102/202.2
5,367,125 A * 11/1994 Viret et al. ..... 174/50.56
5,404,263 A 4/1995 Graves et al. ..... 361/247

(Continued)

FOREIGN PATENT DOCUMENTS

DE 2904174 2/1979

(Continued)

OTHER PUBLICATIONS

European Search Report dated Aug. 6, 2010 for EP10002045.2-1260 (7 pages).

(Continued)

*Primary Examiner* — Michael Carone
*Assistant Examiner* — Daniel Troy
(74) *Attorney, Agent, or Firm* — Taylor IP, P.C.

(57) ABSTRACT

The present invention relates to a metal-sealing material-feedthrough for igniters of airbags or belt tensioning devices, especially glass-metal-feedthrough, including at least one metal pin which is located in a feedthrough opening in the base body in a sealing material, wherein the base body has a front side and a back side. Structure is provided between the front and the back side in order to avoid a relative movement of sealing material in the direction toward the back relative to the inside circumference of the feedthrough opening. At least the feedthrough opening is punched out of the base body. The base body is configured so that the ratio of thickness (D) of the base body to the maximum dimension of the feedthrough opening vertical to the axis direction of the feedthrough opening is in the range of between and including 0.9 to 1.6.

29 Claims, 8 Drawing Sheets

U.S. PATENT DOCUMENTS

| | | | | |
|---|---|---|---|---|
| 5,538,527 | A * | 7/1996 | Viret et al. | 65/43 |
| 5,621,183 | A | 4/1997 | Bailey | 102/202.7 |
| 5,732,634 | A | 3/1998 | Flickinger et al. | 102/202.5 |
| 5,988,069 | A | 11/1999 | Bailey | |
| 6,274,252 | B1 | 8/2001 | Naugler et al. | 428/621 |
| 6,877,431 | B2 | 4/2005 | Heeke | |
| 6,936,303 | B1 | 8/2005 | Katsuda et al. | |
| 7,124,688 | B2 | 10/2006 | Avetisian et al. | |
| 7,770,520 | B2 | 8/2010 | Fink et al. | |
| 2002/0069781 | A1 | 6/2002 | Avetisian et al. | 102/202.7 |
| 2002/0174792 | A1 * | 11/2002 | Kubozuka et al. | 102/202.12 |
| 2004/0079545 | A1 | 4/2004 | Heeke | |
| 2004/0216631 | A1 * | 11/2004 | Fink et al. | 102/200 |
| 2004/0250542 | A1 | 12/2004 | Nishina | |
| 2006/0207469 | A1 | 9/2006 | Fink et al. | |
| 2008/0250963 | A1 | 10/2008 | Fink et al. | |
| 2010/0229616 | A1 | 9/2010 | Fink et al. | |

FOREIGN PATENT DOCUMENTS

| | | | |
|---|---|---|---|
| DE | 34 14 625 | | 4/1984 |
| DE | 34 15 625 | A1 | 10/1985 |
| DE | 199 27 233 | | 6/1999 |
| DE | 101 33 223 | | 7/2001 |
| DE | 203 14 580 | | 9/2003 |
| DE | 103 48 944 | | 10/2003 |
| DE | 10 2006 004 036 | A1 | 8/2007 |
| EP | 0 248 977 | | 2/1987 |
| EP | 1 225 415 | | 10/2000 |
| EP | 1 491 848 | | 3/2003 |
| EP | 1 455 160 | | 2/2004 |
| EP | 1 455 160 | A1 | 9/2004 |
| EP | 1 813 906 | A1 | 8/2007 |
| EP | 2 187 162 | A2 | 5/2010 |
| EP | 2 270 417 | A2 | 1/2011 |

OTHER PUBLICATIONS

Communication dated May 21, 2007 from European Patent Office including European Search Report (dated May 10, 2007) and European Search Opinion for European patent application No. EP 06 021 694.2 (7 pages).

Communication dated Aug. 12, 2009 from European Patent Office for European patent application No. EP 06 021 694.2 (5 pages).

Communication dated Dec. 1, 2010 from European Patent Office for European patent application No. EP 06 021 694.2 (8 pages).

Communication dated Dec. 17, 2010 from European Patent Office for European patent application No. EP 06 021 694.2 (50 pages).

Letter dated Mar. 4, 2011 from Dr. Michael Sawodny to European Patent Office, including corrected English translation of claims, for European patent application No. EP 06 021 694.2 (8 pages).

EP 2 187 162 A3 including European Search Report dated Jul. 30, 2010 for European Patent Application No. EP 10 00 2045 (4 pages).

Communication dated Jul. 28, 2010 from European Patent Office for European patent application No. EP 06 021 694.2 (5 pages).

Communications dated Oct. 18, 2010 and Oct. 29, 2010 from European Patent Office for European patent application No. EP 06 021 694.2 (2 pages).

Communication dated Oct. 17, 2011 from European Patent Office for European Patent Application No. EP 10 00 9062, including European Search Report (dated Oct. 6, 2011) and written opinion (8 pages).

* cited by examiner

Fig.1b

Table 1

| Ratio Thickness/Hole diameter | | Thickness after grinding [in mm] | | | | | | | | | | |
|---|---|---|---|---|---|---|---|---|---|---|---|---|
| | | 2 | 2,1 | 2,2 | 2,3 | 2,4 | 2,5 | 2,6 | 2,7 | 2,8 | 2,9 | 3 |
| Hole diameter [in mm] | 1,6 | 1,3 | 1,3 | 1,4 | 1,4 | 1,5 | 1,6 | 1,6 | 1,7 | 1,8 | 1,8 | 1,9 |
| | 1,7 | 1,2 | 1,2 | 1,3 | 1,4 | 1,4 | 1,5 | 1,5 | 1,6 | 1,6 | 1,7 | 1,8 |
| | 1,8 | 1,1 | 1,2 | 1,2 | 1,3 | 1,3 | 1,4 | 1,4 | 1,5 | 1,6 | 1,6 | 1,7 |
| | 1,9 | 1,1 | 1,1 | 1,2 | 1,2 | 1,3 | 1,3 | 1,4 | 1,4 | 1,5 | 1,5 | 1,6 |
| | 2 | 1 | 1,1 | 1,1 | 1,2 | 1,2 | 1,3 | 1,3 | 1,4 | 1,4 | 1,5 | 1,5 |
| | 2,1 | 1 | 1 | 1 | 1,1 | 1,1 | 1,2 | 1,2 | 1,3 | 1,3 | 1,4 | 1,4 |
| | 2,2 | 0,9 | 1 | 1 | 1 | 1,1 | 1,1 | 1,2 | 1,2 | 1,3 | 1,3 | 1,4 |
| | 2,3 | 0,9 | 0,9 | 1 | 1 | 1 | 1,1 | 1,1 | 1,2 | 1,2 | 1,3 | 1,3 |
| | 2,4 | 0,8 | 0,9 | 0,9 | 1 | 1 | 1 | 1,1 | 1,1 | 1,2 | 1,2 | 1,3 |
| | 2,5 | 0,8 | 0,8 | 0,9 | 0,9 | 1 | 1 | 1 | 1,1 | 1,1 | 1,2 | 1,2 |
| | 2,6 | 0,8 | 0,8 | 0,8 | 0,9 | 0,9 | 1 | 1 | 1 | 1,1 | 1,1 | 1,2 |
| | 2,7 | 0,7 | 0,8 | 0,8 | 0,9 | 0,9 | 0,9 | 1 | 1 | 1 | 1,1 | 1,1 |
| | 2,8 | 0,7 | 0,8 | 0,8 | 0,8 | 0,9 | 0,9 | 0,9 | 1 | 1 | 1 | 1,1 |
| | 2,9 | 0,7 | 0,7 | 0,8 | 0,8 | 0,8 | 0,9 | 0,9 | 0,9 | 1 | 1 | 1 |
| | 3,0 | 0,7 | 0,7 | 0,7 | 0,8 | 0,8 | 0,8 | 0,9 | 0,9 | 0,9 | 1 | 1 |
| | 3,1 | 0,6 | 0,7 | 0,7 | 0,7 | 0,8 | 0,8 | 0,8 | 0,9 | 0,9 | 0,9 | 1 |
| | 3,2 | 0,6 | 0,7 | 0,7 | 0,7 | 0,8 | 0,8 | 0,8 | 0,8 | 0,9 | 0,9 | 0,9 |
| | 3,3 | 0,6 | 0,6 | 0,7 | 0,7 | 0,7 | 0,8 | 0,8 | 0,8 | 0,8 | 0,9 | 0,9 |
| | 3,4 | 0,6 | 0,6 | 0,6 | 0,7 | 0,7 | 0,7 | 0,8 | 0,8 | 0,8 | 0,9 | 0,9 |
| | 3,5 | 0,6 | 0,6 | 0,6 | 0,7 | 0,7 | 0,7 | 0,7 | 0,8 | 0,8 | 0,8 | 0,9 |

1000

1100

Fig.1c

Table 2

| Ratio Thickness/Hole diameter | | Thickness after stamping/before grinding [in mm] | | | | | | | | | | |
|---|---|---|---|---|---|---|---|---|---|---|---|---|
| | | 2,4 | 2,5 | 2,6 | 2,7 | 2,8 | 2,9 | 3 | 3,1 | 3,2 | 3,3 | 3,4 |
| Hole diameter [in mm] | 1,6 | 1,5 | 1,6 | 1,6 | 1,7 | 1,8 | 1,8 | 1,9 | 1,9 | 2 | 2,1 | 2,1 |
| | 1,7 | 1,4 | 1,5 | 1,5 | 1,6 | 1,6 | 1,7 | 1,8 | 1,8 | 1,9 | 1,9 | 2 |
| | 1,8 | 1,3 | 1,4 | 1,4 | 1,5 | 1,6 | 1,6 | 1,7 | 1,7 | 1,8 | 1,8 | 1,9 |
| | 1,9 | 1,3 | 1,3 | 1,4 | 1,4 | 1,5 | 1,5 | 1,6 | 1,6 | 1,7 | 1,7 | 1,8 |
| | 2 | 1,2 | 1,3 | 1,3 | 1,4 | 1,4 | 1,5 | 1,5 | 1,6 | 1,6 | 1,7 | 1,7 |
| | 2,1 | 1,1 | 1,2 | 1,2 | 1,3 | 1,3 | 1,4 | 1,4 | 1,5 | 1,5 | 1,6 | 1,6 |
| | 2,2 | 1,1 | 1,1 | 1,2 | 1,2 | 1,3 | 1,3 | 1,4 | 1,4 | 1,5 | 1,5 | 1,5 |
| | 2,3 | 1 | 1,1 | 1,1 | 1,2 | 1,2 | 1,3 | 1,3 | 1,3 | 1,4 | 1,4 | 1,5 |
| | 2,4 | 1 | 1 | 1,1 | 1,1 | 1,2 | 1,2 | 1,3 | 1,3 | 1,3 | 1,4 | 1,4 |
| | 2,5 | 1 | 1 | 1 | 1,1 | 1,1 | 1,2 | 1,2 | 1,2 | 1,3 | 1,3 | 1,4 |
| | 2,6 | 0,9 | 1 | 1 | 1 | 1,1 | 1,1 | 1,2 | 1,2 | 1,2 | 1,3 | 1,3 |
| | 2,7 | 0,9 | 0,9 | 1 | 1 | 1 | 1,1 | 1,1 | 1,1 | 1,2 | 1,2 | 1,3 |
| | 2,8 | 0,9 | 0,9 | 0,9 | 1 | 1 | 1 | 1,1 | 1,1 | 1,1 | 1,2 | 1,2 |
| | 2,9 | 0,8 | 0,9 | 0,9 | 0,9 | 1 | 1 | 1 | 1,1 | 1,1 | 1,1 | 1,2 |
| | 3,0 | 0,8 | 0,8 | 0,9 | 0,9 | 0,9 | 1 | 1 | 1 | 1,1 | 1,1 | 1,1 |
| | 3,1 | 0,8 | 0,8 | 0,8 | 0,9 | 0,9 | 0,9 | 1 | 1 | 1 | 1,1 | 1,1 |
| | 3,2 | 0,8 | 0,8 | 0,8 | 0,8 | 0,9 | 0,9 | 0,9 | 1 | 1 | 1 | 1,1 |
| | 3,3 | 0,7 | 0,8 | 0,8 | 0,8 | 0,8 | 0,9 | 0,9 | 0,9 | 0,9 | 1 | 1 |
| | 3,4 | 0,7 | 0,7 | 0,8 | 0,8 | 0,8 | 0,9 | 0,9 | 0,9 | 0,9 | 1 | 1 |
| | 3,5 | 0,7 | 0,7 | 0,7 | 0,8 | 0,8 | 0,8 | 0,9 | 0,9 | 0,9 | 0,9 | 1 |

1000

1100

METAL-SEALING MATERIAL-FEEDTHROUGH AND UTILIZATION OF THE METAL-SEALING MATERIAL FEEDTHROUGH WITH AN AIRBAG, A BELT TENSIONING DEVICE, AND AN IGNITION DEVICE

BACKGROUND OF THE INVENTION

1. Field of the Invention

The current invention relates to a metal-sealing material-feedthrough. It further relates to usage as well as to a gas generator, airbag and belt tensioning device including an ignition device, comprehensively a metal-sealing material-feedthrough.

2. Description of the Related Art

Metal-sealing material feedthroughs are already known in various forms from the current state of the art. They are understood to be vacuum-tight seals of sealing materials, especially glass or synthetics to metal seals. In this type or arrangement the metals act as electrical conductors. We refer you to representative documentation U.S. Pat. No. 5,345,872, U.S. Pat. No. 3,274,937. Feedthroughs of this type are common in electronic and electrical engineering. The material used for sealing, especially glass, serves as an insulator. Typical metal-sealing material-feedthroughs are constructed such that metallic internal conductors are sealed into a pre-formed sintered glass component, wherein the sintered glass component or the glass tube is sealed into an outer metal component with the so-called base body. Preferred applications for metal-sealing material-feedthroughs of this type are for example ignition devices. One area of application is in airbags or belt tensioning devices in motor vehicles. In this instance the metal-sealing material-feedthroughs are a component part of an ignition device. In addition to the metal-sealing material-feedthrough, the entire ignition device includes an ignition bridge, the explosive agent, as well as a metal shrouding which tightly encloses the ignition mechanism. Either one or two, or more than two metallic pins may be inserted through the feedthrough. In one embodiment with one metallic pin the housing is grounded. In a two-pin embodiment one of the pins is grounded. The previously described ignition device is used especially for airbags or for belt tensioning devices in motor vehicles. Already known ignition devices of the aforementioned, or similar types are described in U.S. Pat. No. 6,274,252, U.S. Pat. No. 5,621,183, DE 29 04 174 A1, DE 199 27 233 A1, U.S. Pat. No. 5,732,634, U.S. Pat. No. 3,134,329, DE 34 14 625 A1 DE 34 15 625 A1, EP 1 225 415 A1, U.S. Pat. No. 3,971,320, EP 0 248 977 B1, US 2002/0069781 A1, DE 101 33 223 A1 as well as EP 1 491 848 A1 and EP 1 455 160 A1 whose disclosure contents are included in their entirety in the present application. The aforementioned ignition units include two metal pins. However, electronic ignition devices with a singular pin are also possible. The ignition devices which are known from the current state of the art include a metal base body or metal sleeve which is constructed as a pivoted component, or they include a base body of synthetic material. The metal base body has at least one feedthrough opening through which at least one metal pin is inserted. One fundamental problem in this embodiment is that this type of construction is material intensive and expensive. Also when constructed as a pivoted component the configuration of the pass through opening deviating from a circular cross section is possible only with additional costs. In addition, pivoted components are characterized by relatively large dimensions which is then reflected in a respectively necessary sizing of the entire ignition device.

Designs of ignition devices are known from EP 1 491 848 A1 which include a pair of electrodes arranged in an insulating material and a base body in the embodiment of a housing. In order to increase the resistance relative to the pressure created when the ignition is triggered and thereby in order to increase the ejection force, ways are provided on one of the components of the metal-sealing material feedthrough which interact with each other. These are provided either on the sealing material, the electrode or on the base body on the surface which is facing the neighboring element. The design on the base body includes at least one step, that is to say—a change in the cross section of the feedthrough opening wherein this causes an enlargement of the surface that is exposed to the pressure during the ignition process. There are no restrictions regarding the material choices for the base body so that, depending upon design, especially when constructed as a pivoted component, the already mentioned disadvantages also occur, which only intensify through the additional necessary inclusion of the required ways for the increase of the tensile force, extraction force, and/or ejection force.

A generic metal-sealing material-feedthrough is already known from EP 1 455 160 A1. This discloses a metal-sealing material-feedthrough which is described in a special design as a glass-to-metal-feedthrough, including one metallic base body through which at least one metal pin is inserted. If two metal pins are provided in a preferred design form then at least one of the two provides the ground connection to the base body at least indirectly, in other words, directly or indirectly through additional elements. In a design having two metal pins said metal pins are located parallel to each other. At least one of the metal pins is located in a feedthrough opening in the base body and is sealed relative to it through sealing material, such as in form of a glass slug. The base body is formed from a sheet metal element wherein in a first design form at least the feedthrough opening is created by a separation process, especially by punching. The base body itself is punched from a solid material. The final geometry of the base body however is achieved through a forming process, for example through deep-drawing. In a preferred design form the final geometry describing the outer contour and the basic geometry describing the feedthrough opening is produced at least by a separation process, especially punching. Final geometry means that no further forming processes will be conducted on this form. Basic geometry means that this either represents the final geometry if no further changes are required or that changes through ways of additional manufacturing processes, especially forming processes may be made, wherein the final geometry is achieved only following these additional processes. Ways are provided between the front and the back side in order to avoid a relative movement of sealing material in the direction toward the back relative to the inside circumference of the feedthrough opening, especially during ignition. The ways are an integral component of the base body or embody a structural unit with same. The manufacture of the base body by way of punching provides the advantage of short manufacturing periods and permits free forming, especially of the feedthrough opening. However, fabrication by way of punching is subject to limits with a view to individual material related parameters exceeding of which would render the fabrication uneconomical and which would also have a negative effect upon the available ejection force.

What is needed in the art is a metal-sealing material-feedthrough of the type mentioned at the beginning, including a base body which has at least one feedthrough opening which is obtained by punching and which is characterized by a high rigidity at low material- and labor expenditure and at the same time by high ejection forces. In addition, assembly errors which are a result of inaccurate coordination of the individual elements are to be avoided.

SUMMARY OF THE INVENTION

The inventive metal-sealing material-feedthrough includes at least one metal pin which is placed in a feedthrough opening in the base body in a sealing material, wherein the base body has a front and a back side. Ways are provided between the front and the back side in order to avoid a relative movement of sealing material in the direction toward the back relative to the inside circumference of the feedthrough opening.

Metal-sealing material-feedthrough openings can generally be characterized by the so-called ejection force and by the extraction force. The ejection force is that force which must be applied in order to eject the sealing material which is placed in the feedthrough opening of the metal-sealing material-feedthrough from said feedthrough. The level of the ejection force may be determined either hydrostatically or mechanically.

If the ejection force is determined mechanically then the surface of the sealing material is treated with a die wherein the die surface which presses upon the sealing material is smaller than the surface of the sealing material.

Alternatively, the ejection force may be measured hydrostatically. In this instance the sealing material is treated with a hydrostatic pressure, for example with water pressure and is then measured; wherein the sealing material is expelled from the feedthrough opening by said hydrostatic pressure.

The extraction force is that force which is required in order to pull the metal pin of the metal-sealing material-feedthrough out of the sealing material.

At least the feedthrough opening on the base body is produced by punching. In a further developed design form of the invention the entire base body, in other words the outside circumference of the base body, as well as the feedthrough opening may also be produced by punching. The entire base body is then constructed as a punched component.

The base body is configured so that the ratio between the thickness of the base body and the maximum dimension of the feedthrough opening vertical to the axis direction of the feedthrough opening is in the range of between and including 0.5 to 2.5. When considering the ratio of thickness D of the base body to the maximum dimension of the feedthrough opening after punching of the feedthrough opening, however before grinding of the feedthrough opening, then this ratio is preferably in the range of 0.6 to 2.5. When considering the ratio of thickness D of the base body to the maximum dimension of the feedthrough opening after a grinding process of the feedthrough opening, then this ratio is preferably in the range of 0.5 to 2.

In accordance with an embodiment, the ratio between the thickness D of the base body and the maximum dimension of the feedthrough opening vertical to the axis direction of the feedthrough opening after grinding is in the range of between and including 0.8 to 1.6, preferably 0.8 to 1.4, especially preferably 0.9 to 1.3, more especially preferably 1.0 to 1.2.

Thickness refers to the extent or dimension in height direction or direction of the extension of the feedthrough opening. The geometric axis of the feedthrough opening is determined depending on the construction of said feedthrough opening. In a symmetric design it corresponds to a symmetrical axis, otherwise to a theoretical center axis.

For applications in ignition devices for airbags base bodies having a thickness of between 1 mm and 5 mm, preferably 1.5 mm and 3.5 mm, especially preferably 1.8 mm to 3.0 mm, more especially preferably 2.0 mm to 2.6 mm are used. Even with consistently sized metal pins this represents a considerable saving in materials due to the smaller dimensions compared to the pivoted component which has thicknesses for example, of 3.2 mm to 5 mm, as well as providing an energy saving manufacturing process. In addition, the reduction in the support surface for the sealing material slug which is inherent with the reduction in the thickness can be compensated for with regard to its function, by simple measures which require almost no additional expenditure.

There are no limitations with regard to the cross sectional geometry of the feedthrough opening. However, a circular or oval cross section can be selected in order to achieve a uniform distribution of tension in the connection between the sealing material and the feedthrough opening. In a circular or oval cross section the diameter of the feedthrough opening is then in the range of 1.4 mm to 4 mm, preferably 1.4 mm to 3.5 mm, especially preferably 1.6 mm to 3.4 mm.

The diameter of the metal pin is for example 0.8 to 1.2 mm.

The metal-sealing material-feedthrough includes a metallic base body through which at least one metal pin is inserted. If two metal pins are provided, then at least one of the two provides the ground-connection to the base body at least indirectly, in other words, directly or indirectly through additional elements. In a design having two metal pins said metal pins can be located parallel to each other. At least one of the metal pins is located in a feedthrough opening in the base body and is sealed relative to it through sealing material, such as in form of a glass slug.

In order to account for the problem arising from fusing of the individual metal pin into a feedthrough opening and also for safeguarding against expulsion of the sealing material and metal pin entity, ways are provided to avoid a relative movement of sealing material in the direction toward the back side relative to the inside circumference of the feedthrough opening. These act as barbs and during relative movement in the direction toward the backside lead to a positive fit between the sealing material slug, especially a glass slug and the base body. They include for example at least one local narrowing of the feedthrough opening wherein this can be provided in the entire area of the inside circumference, with the exception of the front side of the base body.

The current invention provides for cost effective manufacturing processes and starting materials wherein the material usage is considerably reduced. The entire base body may also be constructed as an integral component into which the metal pin is fused by way of the sealing material, in other words for example by way of the glass slugs. An additional substantial advantage is that even under an increased load upon the glass slug—for example a pressure load—pushing the glass blob with the metal pin out of the feedthrough opening can probably be avoided. The entire embodiment when compared with a pivoted component is lower in height and assures a secure bonding of the glass slug in the base body, even during high ejection force.

It is however critical that the local narrowing of the cross section occurs in the area of the backside or between the back side and the front side, wherein however the front side is always characterized by a larger diameter. The cited ratio details always refer to the largest cross section or the largest dimension of the feedthrough opening. The dimensional reduction—resulting from the undercut—of the area adjacent to this vertical to the direction of axis of the feedthrough opening originating from the axis, or the difference between the dimensions of the largest and the smallest cross section is always in the range of between 0.05 mm to 1 mm, preferably 0.08 mm to 0.9 mm, preferably between 0.1 mm to 0.3 mm. Accordingly this dimension provides an enlargement of the surface at the inside circumference of the feedthrough opening which is sufficient to maintain the ratio between thickness and dimension of the feedthrough opening relative to a very small thickness and at the same time to increase the ejection force accordingly. If the feedthrough opening is circular for example, the largest dimension of a cross section is characterized by the diameter of the feedthrough opening. In the instance of an elliptical shape the largest dimension is the dimension of the large axis of the ellipse.

In accordance with another embodiment the second metal pin is placed or secured as a grounding pin to ground at the back side of the base body. This eliminates additional measures of having to ground a metal pin that is sealed into the base body with sealing material, or having to connect it electrically with the base body. In addition, only one pin then needs to be sealed into one feedthrough opening, providing a plurality of possibilities to securely seal the single pin completely in circumferential direction; and the possible connection area for the ground pin can be enlarged.

A glass slug, a ceramics slug, a glass-ceramic slug, a synthetic material, a high performance polymer or a glass/polymer mixture can be used as sealing material.

A plurality of possibilities exists for the specific development of the way for the prevention of a relative movement between sealing material and feedthrough opening, especially prevention of sliding out. These are characterized by measures on the base body and/or the metal pin. In the simplest form one would revert to measures on the base body which can be realized during manufacturing, especially during the punching process. In this context the feedthrough opening distinguishes itself by a change of the cross sectional progression between the back side and the front side. In the simplest form at least two areas of different inside dimensions are provided in an embodiment of a feedthrough opening that has a circular cross section with different diameters. The cross section change may occur in stages or progressively. In the latter scenario the feedthrough opening is conical between the front and the back, wherein it narrows toward the back side.

The ejection force can be significantly increased through the described measures that can be taken in the area of the feedthrough opening. In the examples according to the current invention including undercut, the hydrostatic pressure which must be applied in order to eject the glass slug is 1500 bar to 2500 bar, preferably 2000 bar to 2500 bar. Or, in other words, the force which must be applied mechanically upon the glass slug in order to eject the glass slug is 1750 N to 3000 N, preferably 2000 N to 3000 N.

The measures which are applied to the base body are normally further characterized by the provision of several recesses or protrusions. These form at least one undercut—originating from the backside—on the inside circumference of the feedthrough opening in the base body between backside and front side wherein the front side has no such undercuts. In a symmetrical embodiment of the feedthrough opening said feedthrough opening is characterized by three partial segments—a first partial segment which extends from the backside in the direction of the front side, a second partial segment adjacent to this and a third partial segment which extends from the front side in the direction of the back side. The second partial segment is characterized by smaller dimensions of the feedthrough opening than the first and the third partial segment. The first and the third partial segments are then characterized by identical cross sectional dimensions.

In embodiments having more than two segments of different dimensions, especially different diameters, methods are selected which are created by two-sided treatment of the base body. If the previously described designs are geared toward an asymmetrical arrangement of the feedthrough opening then a feedthrough opening design is selected in these arrangements having more than two segments which can be used as desired with regard to the installation position. This is shaped symmetrical, relative to a theoretic center axis which progresses vertical to the pin axis of the pin which is located in the base body and which extends in the center area of the base body. This means that the front and backside are interchangeable regarding their function. The thereby formed undercuts counteract possible movements of the sealing material slug in both directions.

An additional possibility to avoid relative movements between the sealing material slug and the feedthrough opening consists in the provision of a frictional connection between these. Normally, for example, the glass is inserted into the opening together with the metal pin. The glass and metal pin are heated, so that after cooling the metal shrinks onto the glass slug. The feedthrough opening generally represents essentially its final diameter after being punched. Naturally, the punched feedthrough opening may be further processed, for example ground without substantially altering the final diameter. The feedthrough opening may have a circular cross section. Other possibilities are feasible, for example an oval cross section.

In accordance with an advantageous further development measures are provided on the metal pin, in order to further prevent relative movement occurring under load between the metal pin and the sealing material. This may be at least one protrusion which extends in circumferential direction around the entire outside circumference of the metal pin. Alternatively, being optional or strictly pre-defined, this may respectively be protrusions or recesses extending over the entire outside circumference of the metal pin, such as firmly positioned protrusions located adjacent to each other and in circumferential direction. Due to measures taken on the metal pin the extraction force of the metal pin is in the range of 160 N to 380 N, preferably 300 N to 380 N.

The method for the fabrication of a base body of a metal-feedthrough is characterized in that in order to obtain the base geometry which describes the fundamental shape of the feedthrough opening for at least one metal pin it is punched from a sheet metal component. The end contour describing the outer geometry may be obtained by a separation process without tension-causing processing of a sheet metal component of pre-defined thickness. Both processes may be combined in a cost saving effort to one machine tool and one operating cycle. The undercut in the feedthrough openings are formed by change in shape of the feedthrough opening, for example through stamping. The individual stamping process may occur before or after the punching process. The stamping and punching process respectively could occur on the same side of the base body in order to avoid unnecessary position changes of the work piece and to possibly conduct these processes immediately following each other.

According to the desired geometry that is to be obtained, the stamping processes occur on one or on both sides, wherein in the latter scenario identical stamping parameters can be set in order to assure a symmetrical appearance of the feedthrough opening.

Materials for the base body can be metals, especially standard steel such as St 35, St 37, St 38 or special steel or stainless steel types. Stainless steel according to DIN EN 10020 is a designation for alloyed and unalloyed steels whose sulfur and phosphor content (so-called companion elements to iron) does not exceed 0.035%. Additional heat treatments (for example tempering) are often provided subsequently. Special steels include for example high purity steels wherein components such as aluminum and silicon are eliminated from the molten mass in a special manufacturing process. They also include high alloy tool steels which are intended for later heat treatment. The following are examples of what may be utilized: X12CrMoS17, X5CrNi1810, XCrNiS189, X2CrNi1911, X12CrNi177, X5CrNiMo17-12-2, X6CrNiMoTi17-12-2, X6CrNiTi1810 and X15CrNiSi25-20, X10CrNi1808, X2CrNiMo17-12-2, X6CrNiMoTi17-12-2. The advantage of the aforementioned materials, especially the cited tool steels, is that when using these materials a high corrosion resistance, a high mechanical rigidity as well as excellent weldability is assured, especially where the base body is in the embodiment of a punched component with a welded edge.

The inventive metal-sealing material-feedthrough, especially glass-metal feedthrough, may be utilized in ignition devices of any desired design. It may for example be provided in an ignition device for a pyrotechnic protective device, especially an airbag or belt tensioning device, including a cap which is connected with the metal-sealing material-feedthrough, especially with the base body, wherein a propellant is enclosed between the metal-boding material-feedthrough and the cap and wherein the base body has a welded edge that is thinner than the interior part or section, wherein the cap is welded to the welded edge with a continuous weld seam.

There are no limitations with regard to the geometry of the outer contour of the base body. However, if said base body is in the form of a punched component it can be in circular form. The location of the feedthrough may be co-axial or eccentric to the opening center axis, or in a symmetrical embodiment of the outside contour of the base body it may be co-axial or eccentric to the axis of symmetry.

The ignition devices with the inventively constructed metal-sealing material-feedthrough can be utilized in gas generators, for example hot gas generators, cold gas generators, hybrid generators. Additional areas of application are ignition devices for pyrotechnical protective systems, for example airbags and belt tensioning devices.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein:

FIG. 1*b* provides Table 1;

FIG. 1*c* provides Table 2;

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1A:
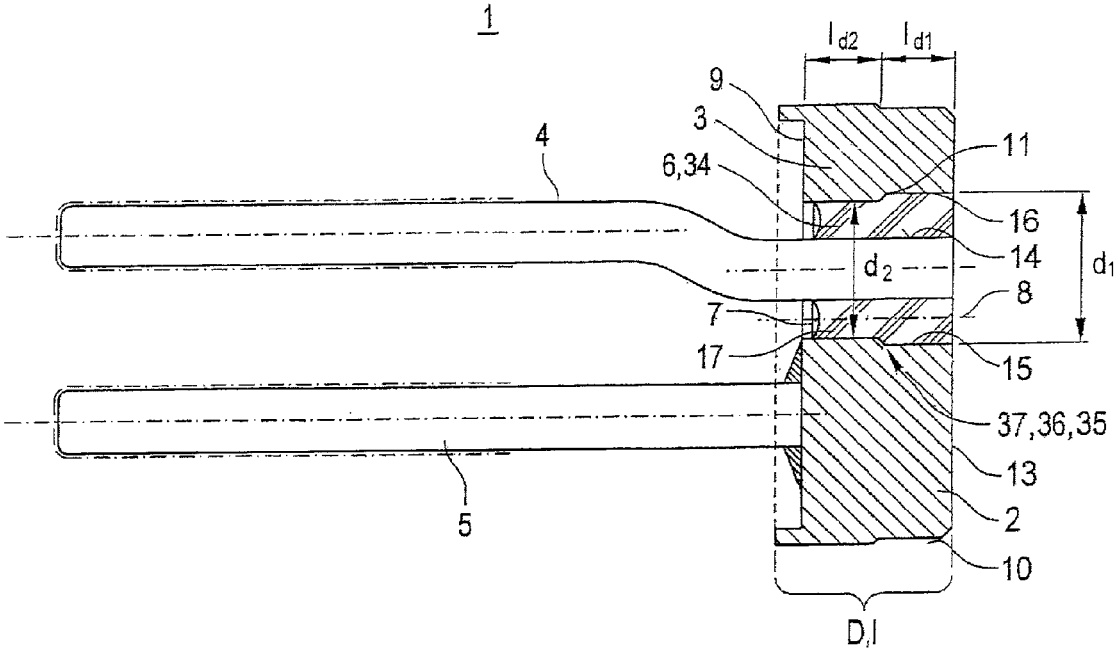
FIG. 1*a* illustrates an embodiment of metal-sealing material-feedthrough in accordance with the current invention.

Referring now to the drawings, and more particularly to FIG. 1*a*, there is shown, with the assistance of an axial section, a first design of an inventively constructed metal-sealing material-feedthrough 1, which can be used as an igniter or an ignition device of an airbag. This includes a base body 3 forming a metal collar 2 with which two parallel metal pins 4 and 5 are electrically connected. The two metal pins 4 and 5 are located parallel to each other. One of said metal pins functions as a conductor while the second one is grounded. In the illustrated example the first metal pin 4 functions as conductor and the metal pin 5 as grounding pin. At least one of the metal pins, especially the one metal pin 4 functioning as conductor is inserted through the base body 3. In this context the metal pin 4 is sealed over a section of its length 1 in sealing material 34, especially in a glass slug 6 which is cooled from a molten glass mass. In the illustrated example the metal pin 4 protrudes at least on one side from the face 7 of the glass slug 6 and, after completion of the fabrication process terminates flush with the second face 8 of the glass slug 6. In order to avoid dents in the area of the feedthrough opening 11 during cooling of the sealing material which would lead to an undesirable weakening of the seal between the sealing material and the base body 3 in the front area 13, the metal pin 4 is arranged in the feedthrough opening 11 during the sealing process in such a manner that it protrudes beyond the base body 3 and thereby beyond the front side 13. Following sealing or encapsulation the metal pin 4 and the protruding cooled sealing material may be ground so that it is flush with the front side 13 and therefore also making the face 8 of the glass slug 6 flush with the front side 13 of the base body 3. Other variations are also feasible. In the illustrated example the ground pin 5 is secured directly onto the back side 12 of the base body 3. The base body 3 is designed as a punched component. A punched component in accordance with the current application is one wherein at least one feedthrough opening 11, and possibly also the end geometry of the base body 3, is produced by punching. In accordance with an advanced design the geometry describing the outer contour, especially the outside circumference 10 may be produced through cut-out, such as through punching. The punched component can subsequently be used either in the form it embodies after the punching process or it can be reshaped, for example stamped or deep-drawn in an additional immediately following process.

The feedthrough opening 11 which serves to retain and seal the metal pin 4 by way of the glass slug 6 is produced by a punching process in the form of a hole Subsequently the metal pin 4 is inserted into the feedthrough opening 11 at the back side 12 of the metal-sealing material-feedthrough 1, together with the glass slug. The metal body containing the glass slug 6 and the metal pin is heated so that the metal shrinks after a cooling process, thereby producing a frictional connection between the glass slug 6 with the metal pin 4 and the base body 3.

It is also feasible to bring the sealing material 34 in its molten or free flowing condition, especially the molten glass from the front side 13 into the feedthrough opening 11. During cooling a positive fit or material seal is created between the outside circumference 14 of the metal pin 4, as well as the inside circumference 15 of the feedthrough opening 11. In accordance with the current invention the base body 3 is designed such that the ratio between the thickness D of the base body 3 and the maximum possible dimension of the feedthrough opening 11 vertical to the direction of the axis of the feedthrough opening 11 is in the range of between and including 0.5 to 2.5. Depending upon the design of the feedthrough opening 11 which may for example be characterized by a circular cross section or an oval cross section, the maximum possible dimension is determined by the diameter d or the length of the oval. The axial direction is consistent with the geometric axis, especially the axis of symmetry of the feedthrough opening 11 and extends through the base body 3. If the base body 3 is in the embodiment of a punched component, it is preferable in order to produce an especially compact, cost efficient and energy efficient base body 3 including the desired characteristic, especially the desired force of ejection when triggering the ignition, that the ratio between the thickness D of the base body 3 and the maximum possible dimension of the feedthrough opening 11 vertical to the direction of the axis of the feedthrough opening 11 is selected in a range of between and including 0.8 to 1.6, preferably 0.8 to 1.4, especially preferably 0.9 to 1.3, more especially preferably 1.0 to 1.2. Specifically expressed in dimensions this means that for example, the thickness D of the base body 3 is between 1 and 5 mm, preferably 1.5 mm and 3.5 mm, especially preferably 1.8 mm to 3.0 mm, more especially preferably 2.0 to 2.6 mm. Compared to pivoted components a substantially smaller construction is realized and in addition, the cross section of the feedthrough opening 11 may be selected as desired, depending upon requirement.

Table 1 and Table 2 of FIGS. 1*b* and 1*c* list the absolute values of a circular hole diameter, in other words the diameter of the feedthrough opening as well as the thickness of the base body which contains the feedthrough opening, as well as the resulting ratio between thickness and hole diameter. Table 1, according to FIG. 1*b*, lists the values of the hole diameter relative to the values of the thickness of the base body after the grinding process. Through the grinding process which, as previously described, serves to grind protruding parts of the glass slug, the thickness of the entire body is reduced by approximately 0.4 mm. The hole diameter is stated in mm in Table 1. According to Table 1, the hole diameters range from 1.6 mm to 3.5 mm. In addition, the thicknesses of the base body after grinding are stated in mm. The thicknesses of the base body after grinding range from 2.0 to 3.0 mm. The resulting ratios of thickness to hole diameter are also listed. The framed section 1000 indicates the preferred range of the diameters as well as the ratios of thickness to hole diameter. Section 1100 shows the especially preferred range.

Table 2 of FIG. 1*c* shows the thickness of the base body after punching, however before the grinding process, in mm, as well as the hole diameter in mm. In addition, the ratio of thickness to hole diameter is also listed. Again, the preferred ranges are indicated by 1000 and the especially preferred ranges by 1100.

In order to avoid loosening of the metal pin 4 with the glass slug 6 from the base body 3 during the stress associated with ignition, even with the smaller support surface resulting from the shortening of the feedthrough opening 11, a way to prevent a relative movement between sealing material 34 and inside circumference 15 of the feedthrough opening in the direction of the backside 12 is provided and is identified here by 35.

These function as barbs and under the effects of tensile force and/or pressure upon the glass slug 6 and/or the metal pin 4 lead to a positive fit between the base body 3 and the glass slug 6 and thereby prevent sliding out on the back side 12. The feedthrough opening can be designed such that it has an undercut 36 which is formed by a protrusion 37. This is located in the area of the back side 12 and in the illustrated example, has a positive fit with it. The feedthrough opening 11, which, in the illustrated example, can possess a circular cross section, is characterized by this protrusion 37 through two different diameters $d_1$ and $d_2$. Diameter $d_1$ is larger than diameter $d_2$. Diameter $d_2$ is the diameter of the feedthrough opening 11 on the back side 12. Diameter $d_1$ is the diameter of the feedthrough opening 11 on the front side 13. However, the feedthrough opening 11 is constructed as having a constant diameter d1 along a substantial section of its extension $l_{d1}$. $l_{d2}$ designates the feedthrough opening 11 with the diameter $d_2$. This means that the feedthrough opening has two partial segments, a first partial segment 16 and a second partial section 17, wherein the first partial segment 16 is characterized by the diameter d1 and the second partial segment 17 by the diameter $d_2$. These diameters are produced by a one-sided punching process in the form of hole-punching from the front side 13 or the back side 12 with a subsequent forming process under the influence of pressure, especially stamping. The punching and forming process can occur from the same side—in the illustrated example from the front side 13. Punching out of the base body 3 can occur also within the scope of the punching process for the feedthrough opening 11, in other words during the same process step. The tool for this is formulated such that the entire base body 3 including a feedthrough opening 11 is punched in one process step from a sheet metal having a certain sheet thickness b which is consistent with a thickness D of the base body 3. In accordance with the present invention, the above referenced ratios between the thickness D of the base body 3 and the dimension of the feedthrough opening 11 are adhered to in order to achieve a high tensile force, ejection force, and/or extraction force at a reduced thickness when compared to pivoted components, thereby achieving an especially cost effective and material effective fabrication. By merely providing an undercut 36 the tensile force, ejection force, and/or extraction force can be almost doubled. According to the invention the undercut 36 and thereby the protrusion 37 is configured such that a cross sectional reduction in the partial section 17 occurs which is characterized by a reduction in diameter, in other words the difference $\Delta d=d_1-d_2$, or a reduction of the maximum dimension in the range if 0.05 to 1 mm, in the range of 0.08 to 0.9 mm, preferably 0.1 to 0.3 mm. The difference $\Delta=d_1-d_2$ in diameter which leads to the undercut 36 and the protrusion 37 is sufficient to compensate for the shorter construction and thereby the shorter length of the feedthrough opening in a punched component when compared with a pivoted component, wherein in addition the ejection force is also increased.

Materials for the base body can be metals, especially standard steel such as St 35, St 37, St 38 or special steel or stainless steel types. Stainless steel according to DIN EN 10020 is a designation for alloyed and unalloyed steels whose sulfur and phosphor content (so-called companion elements to iron) does not exceed 0.035%. Additional heat treatments (for example tempering) are often provided subsequently. Special steels include for example high purity steels wherein components such as aluminum and silicon are eliminated from the molten mass in a special manufacturing process. They also include high alloy tool steels which are intended for later heat treatment. The following are examples of what may be utilized: X12CrMoS17, X5CrNi1810, XCrNiS189, X2CrNi1911, X12CrNi177, X5CrNiMo17-12-2, X6CrNiMoTi17-12-2, X6CrNiTi1810 and X15CrNiSi25-20, X10CrNi1808, X2CrNiMo17-12-2, X6CrNiMoTi17-12-2.

The advantage of the aforementioned materials, especially the cited tool steels, is that when using these materials a high corrosion resistance, a high mechanical rigidity as well as excellent weldability is assured.

In the arrangement depicted in FIG. 1*a* the feedthrough opening 11 has a circular cross section. However, other forms are also feasible wherein in this instance an undercut is formed by changing the inside dimensions of the opening. In addition the illustrated geometries are reproduced in an idealized manner. In practice, surface areas will occur as a rule which is not positioned at true right angle with each other. It is critical that a fundamental profile is created for the feedthrough opening which, on the one hand, meets the challenge of holding a sealed-in metal pin and also of avoiding coming out of the entity of metal pin and sealing material, especially glass slug. This means that also the surface areas which form the undercut and the adjacent surface areas may be located at an angle with each other.

Figure 2:
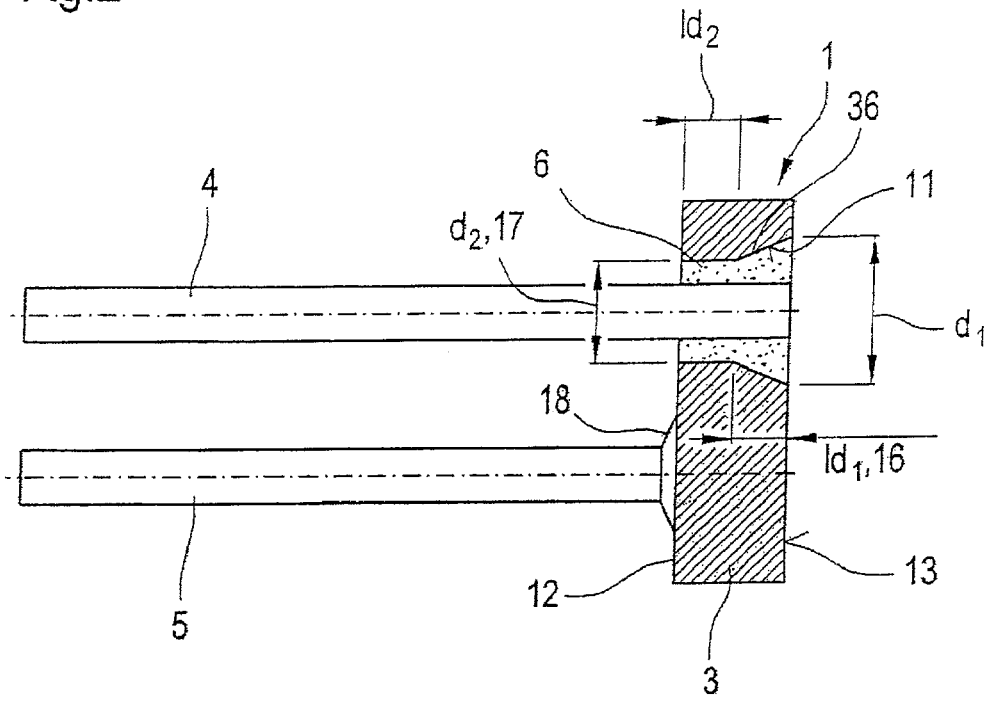
FIG. 2 illustrates an embodiment form of metal-sealing material-feedthrough in accordance with the current invention having a partially conical configuration of the feedthrough opening.

FIG. 2 discloses an arrangement wherein only a section of the feedthrough opening 11 is conical. In this arrangement the feedthrough opening 11 of the metal-sealing material-feedthrough 1, especially in the base body 3 is also divided into 2 segments—a first partial section 16 and a second partial section 17. The second partial section 17 is characterized by a constant diameter $d_2$ along its length $l_{d2}$. The section partial section extends from the backside 12 in direction toward the front side 13. The first partial section 16 is characterized by a progressive cross sectional reduction of the feedthrough opening 11. The decrease occurs from a diameter $d_1$ to a diameter $d_2$. The smaller diameters on the backsides 12 according to the embodiments depicted in FIGS. 1*a* and 2 provide the advantage of a larger connection surface for the metal pin 5, especially the ground pin. The undercut 36 is produced as a result of the diameter change, viewed from the second to the first partial section 16.

In all arrangements depicted in FIGS. 1*a* and 2, the asymmetrical geometry of the feedthrough opening 11, viewed from the front side 13 toward the backside 12 provides the advantage of avoiding a gliding or pulling out of the glass slug 6 on the backside 12, or in the direction towards backside 12. Also, due to the asymmetrical geometry an easier orientation for the installation position of the individual elements is provided, especially for the metal pins 4 and 5. Due to the undercut a separation of the entity of metal pin 4 and glass slug 6 from the base body during ignition is avoided. The additional material on the backside 12 provides the advantage of a larger connection surface for the metal pin 5 that is to be grounded. In addition the tightness of the glass seal of the metal pin is increased by the pressure effects on the front side.

Figure 3:
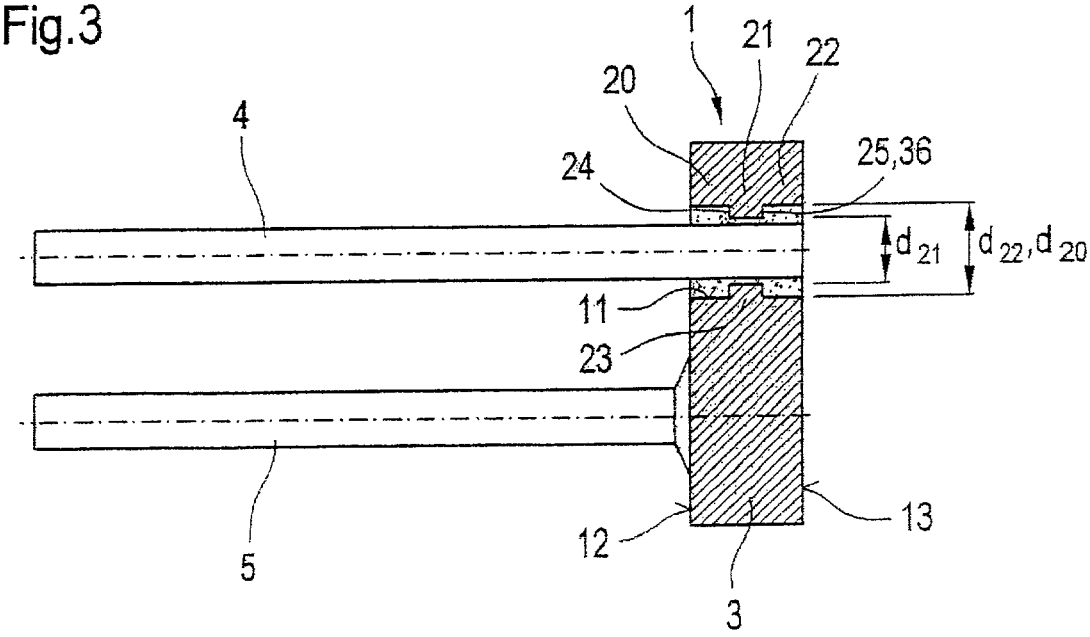
FIG. 3 illustrates an embodiment of the metal-sealing material-feedthrough in accordance with the current invention whose contour describes a protrusion between front and back side in the feedthrough opening.

FIG. 3 illustrates an additional embodiment of an inventive metal-sealing material-feedthrough opening 1. In this embodiment, the feedthrough opening 11 can be divided into three partial sections 20, 21 and 22, wherein the first and third partial section 20 and 22 respectively are characterized by identical diameters $d_{20}$ and $d_{22}$. The second partial section 21 is characterized by a smaller diameter $d_{21}$ than the diameters $d_{20}$ and $d_{22}$, therefore creating a protrusion 23. This forms the undercut 36 which is located between the front and the back side in order to avoid the relative movement of the glass slug 6 in the direction toward the backside 12 relative to the inside circumference 15 of the feedthrough opening 11. Especially the surfaces 24 and 25 which respectively face the front side 13 and the back side 12 form the stop faces in axial direction for the glass slug 6. This arrangement is characterized in that the glass slug 6 is secured in both directions so that this design of the base body is especially advantageous in that it is suitable for any optional installation and positioning, especially with regard to the connection of the metal pins 4. This arrangement provides an increased ejection force in order to move the glass slug 6 by shearing off of components under pressure load.

In all previously described solutions it is possible to use a smaller base body 3 with the same or increased strength of seal provided by the glass slug 6.

The base body 3 according to FIG. 3 is produced by punching of the base body 3 including a feedthrough opening 11 which has a constant diameter. The protrusion is achieved by two-sided stamping to a pre-defined depth with a stamping die that has a larger diameter than the diameter of the feedthrough opening 11 which is produced after punching. Due to the increase in the surface tension of the material on the base body 3 under the influence of the stamping die when exceeding the yielding point causes a creeping of the material which then forms the protrusion 23. It is immaterial whether the stamping process occurs first on the front or the back side of the base body. However, in a desired symmetric arrangement the stamping forces and the stamping depth should be selected to be the same on both sides.

Figure 4:
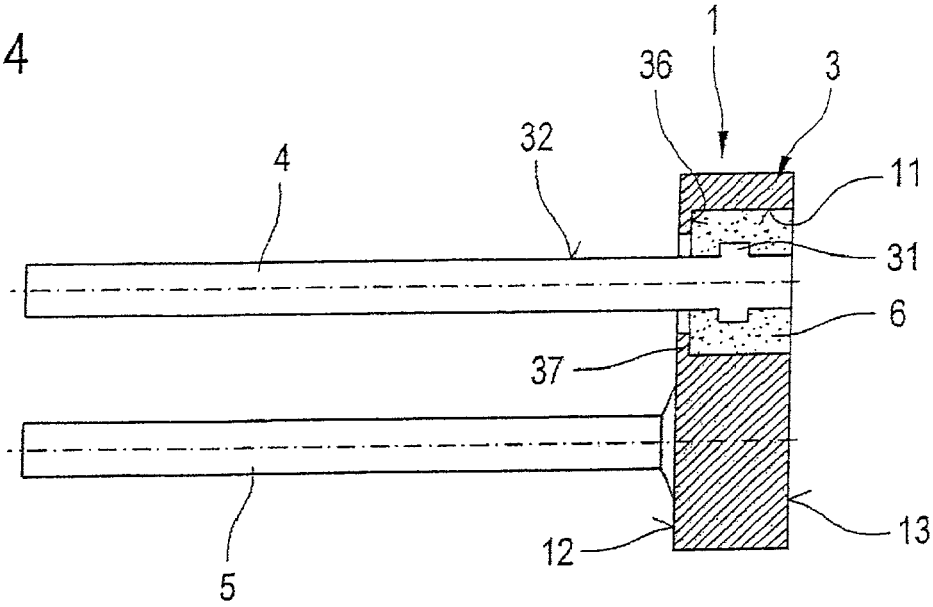
FIG. 4 illustrates an embodiment form according to FIG. 1 with additional protrusions on the metal pin.
Figure 5:
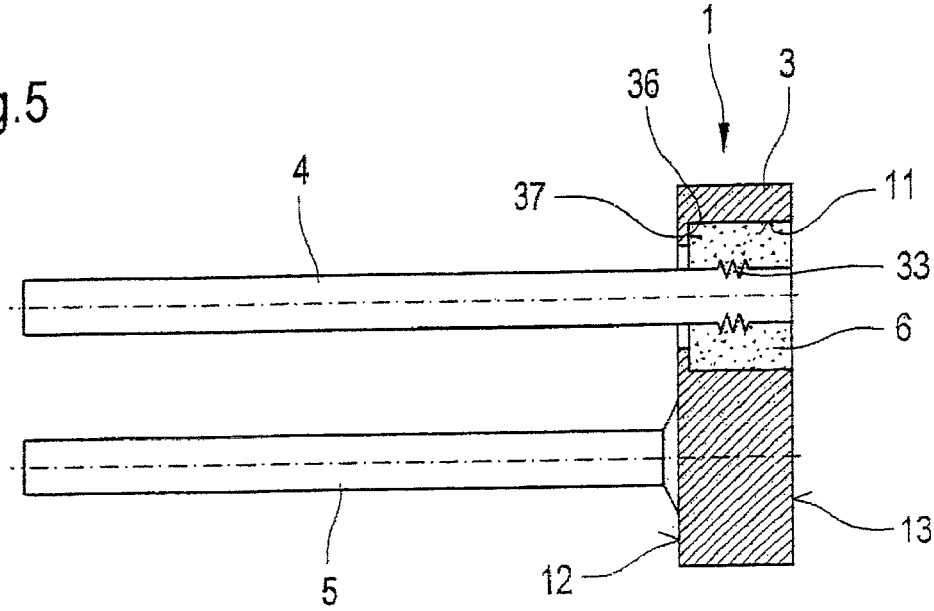
FIG. 5 illustrates a further development according to FIG. 4.

If the FIGS. 1*a* through 3 illustrate measures to be taken on the base body 3, especially the feedthrough openings 11 in order to avoid a relative movement of the glass slug 6 relative to these, then FIGS. 4 and 5 illustrate measures for example to be taken regarding the metal pin 4 which serve to avoid separation of the metal pin 4 from the glass slug 6 during testing and also during the ignition process. The stability of the metal pin in the glass slug is characterized by the extraction force. This measure may be employed by itself or in combination with other ways 35. FIG. 4 illustrates an especially advantageous combination of the design illustrated in FIG. 1, providing for additional modification of the metal pin 4. The pin 4 has at least one protrusion in the connection area with the base body 3. This is identified as 31 and extends in circumferential direction around the outside circumference 32 of pin 4. In this illustrated example a protrusion 31 extends around the entire outside circumference 32 of the metal pin 4. This can be created by compression or crushing of the metal pin 4.

Another possibility which is not illustrated includes an arrangement of several protrusions which are located adjacent to each other in circumferential direction, such as at identical distances from each other on the metal pin 4 in the area of the connection in the base body 3. The characteristic of the protrusions on the metal pin 4 contributes substantially to the improvement in the tightness of the seal. This characteristic prevents the removal of the metal pin 4 during an appropriate test in which the metal pin would normally fail under tension load and removal of the glass slug. This applies in analogy for the embodiment according to FIG. 5. In this scenario the metal pin 4 is equipped with a plurality of protrusions in the contact area with the glass composition which are located axially along the feedthrough opening and are arranged in tandem. In the simplest instance a fluting 33 is used. The same effect can be achieved with this as described in FIG. 4. The remaining construction is consistent with that in FIG. 4. The same identification numbering is therefore used.

In addition the embodiments shown in FIGS. 4 and 5 can also be combined with the measure taken on the base body, especially on the feedthrough openings, as illustrated in FIG. 2.

Figure 6:
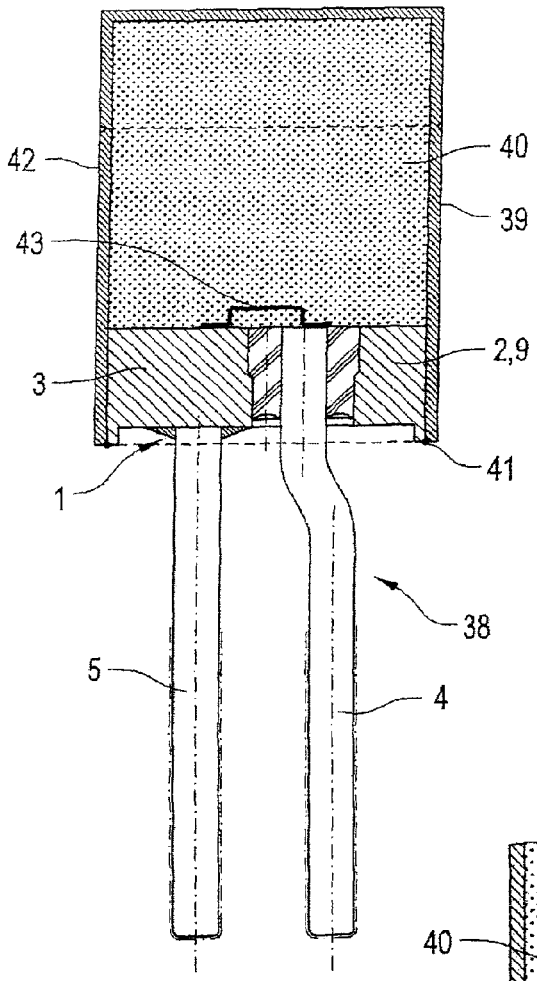
FIG. 6 illustrates an embodiment of an ignition device in accordance with the current invention, including a metal-sealing material feedthrough according to FIG. 1*a;*

FIG. 6 illustrates in a greatly simplified depiction an example of an axial section through an ignition device 38 including a metal-sealing material-feedthrough 1, as shown in FIGS. 1 through 4. The ignition device 38 is produced by utilizing such a feedthrough by sealing of a cap 39 with the base body 3 thereby encasing a propellant 40, wherein the seal occurs for example through a continuous laser weld seam 41 along the welded edge. This produces a hermetically sealed housing 42 for the propellant.

FIG. 6 also depicts a bridge 43 which is connected to the metal pin 4 of the current-feedthrough and the cap 39, or the base body 3 before or during connection of the metal-sealing material feedthrough 1 and cap 39. The ignition bridge 43 may for example be in the form of a filament which is attached to the base body through spot welding. In contrast to the highly simplified illustration in FIG. 6 an advance-propellant is used in addition to the propellant 40 which surrounds the ignition bridge 42.

Figure 7:
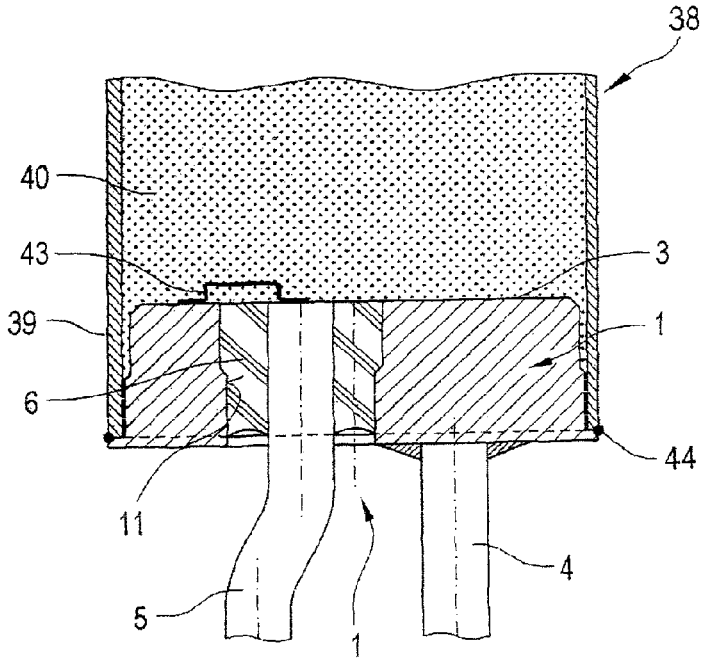
FIG. 7 illustrates a section of a cross section of an additional design form of an ignition device.

FIG. 7 is a sectional view of a cross section through an additional embodiment in an application of an inventive metal-sealing material-feedthrough 1 in an ignition device 38. In this arrangement the welded edge of the base body 3 does not extend in axial direction as in the example illustrated in FIG. 6. It extends in radial direction of the base body 3 and continuous in circumferential direction around it. The welded edge forms a stop 44 when placing the cap 39, so that precise positioning of said cap is very easy. The welded edge can be obtained in an advantageous manner by deep-drawing or extruding of a punched base body 3.

The previously described design examples all referred to metal-sealing material-feedthroughs or glass-metal-feedthroughs including two metal pins which could be located parallel to each other and wherein one of the metal pins is grounded on the backside of the base body. However, the invention can essentially also be applied with more than 2 metal pins and with so-called Mono-Pins. Mono-Pins are ignition devices which include only one singular metal pin which is held in a pin retainer. The pin retainer includes for example a metal ring which represents the ground connection.

Figure 8:
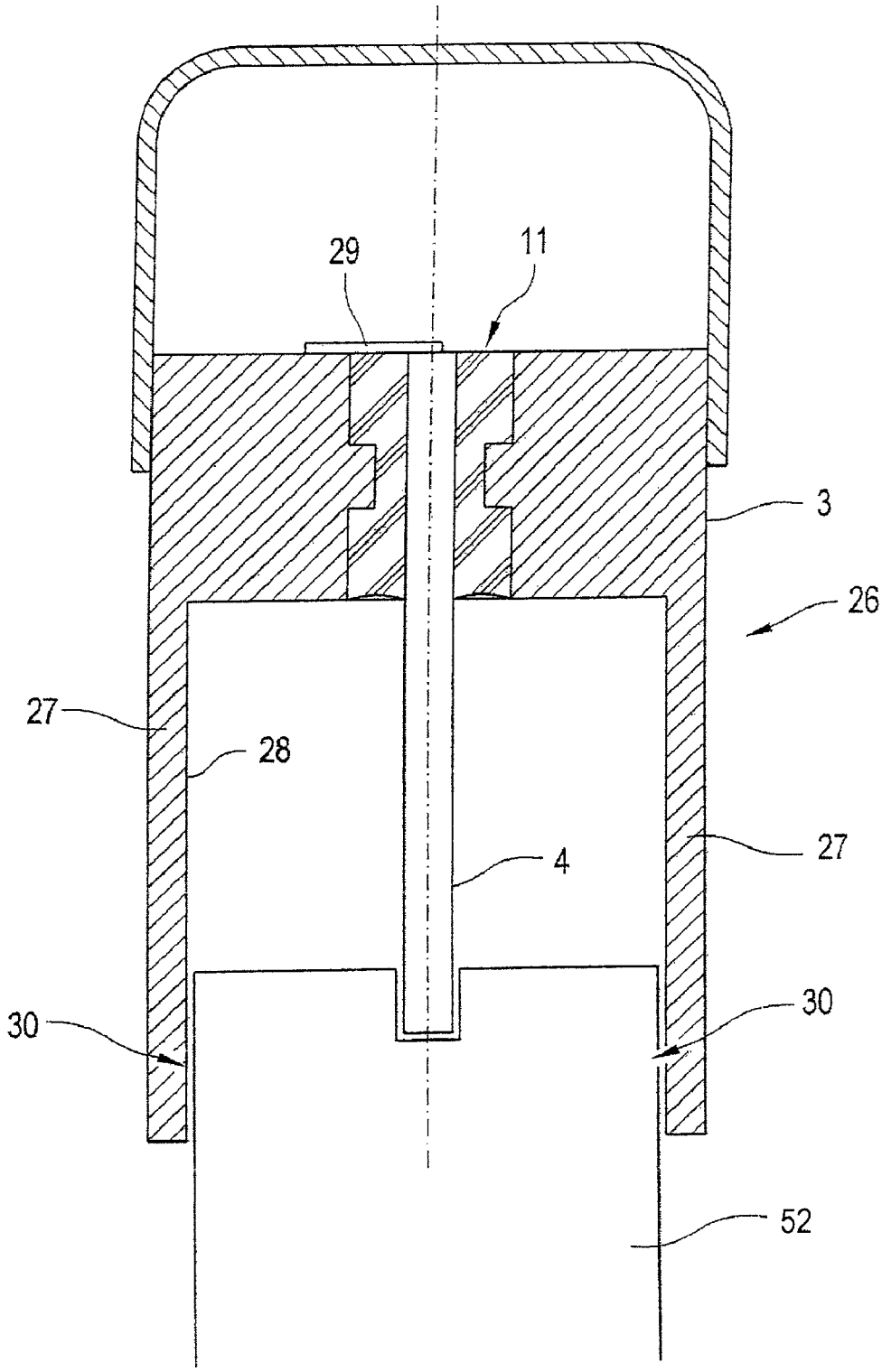
FIG. 8 illustrates an embodiment including a metal pin, a so-called Monopin.

A Mono-Pin of this type is depicted in FIG. 8. The pin retainer 26 includes a metal pin 4 which is embedded in an insulated filling 6 which can be in the form of glass. The pin retainer 26 includes a base body 3 which accepts the metal pin 4, as well as a sleeve 27 with an inside wall surface 28. The end of the sealed in part of the metal pin 4 is connected with the base body 3 by way of an electrically conducting bridge 29.

The feedthrough opening 11 is cut into the base body 3 by way of a punching step. In one design form the base body 3 can be punched out together with the feedthrough opening 11, as previously described. The base body 3, together with the sleeve 27, can form a single-piece component. The fabrication of a single-piece component may for example be accomplished wherein one punched component is produced in one process step and the sleeve is obtained by deep-drawing. Sizing of the feedthrough opening and the thickness of the base body remains as described previously.

The inside wall surface 28 of the sleeve 27, as well as the free end of the metal pin 4, can be coated. Gold, for example, is used as the coating material. Electrolytic coating can be used. The purpose of the coating is to maintain a low electric resistance at the transitional point 30 between a connector 52, which is inserted into the sleeve, and the inside 28 of the sleeve 27.

Figure 9:
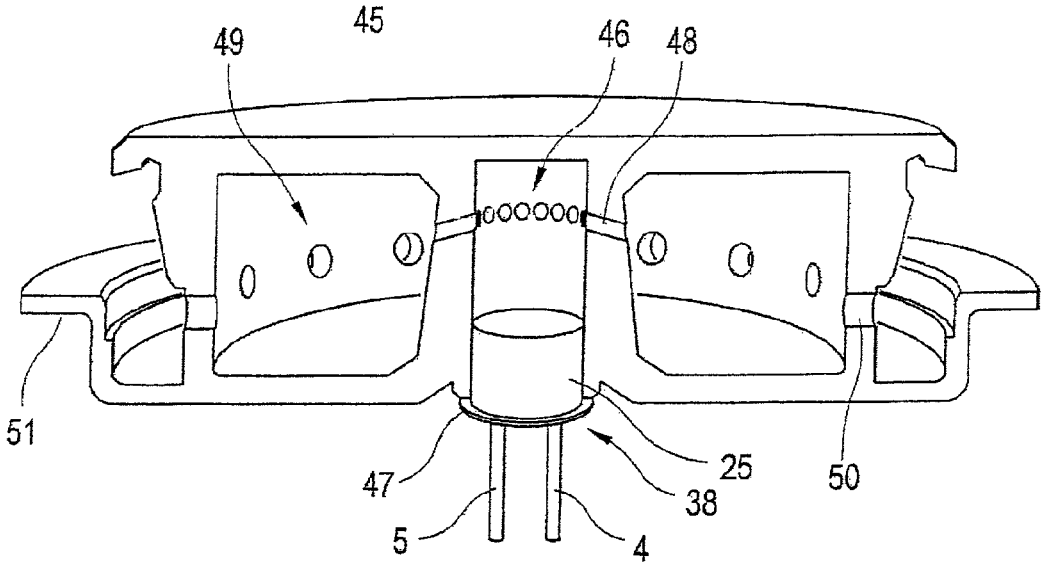
FIG. 9 illustrates an example of a possible application of a metal-sealing material-feedthrough in accordance with the current invention, in an ignition device in a gas generator.

FIG. 9 illustrates a sectional depiction of a gas generator 45 of a pyrotechnical protective device including an ignition device 38 which is not depicted as a sectional view in FIG. 9. The gas generator 45 may be used especially for a steering wheel airbag. For this purpose it is installed in the impact absorber of the steering wheel. The ignition device 38 is located in a centrally located hollow space 46 of the gas generator 45. The ignition device 38 is equipped for example with a flange 47 for mounting at the opening of the central hollow space 46. The central hollow space 46 is connected via channels 48 with a ring shaped propellant container 49 which contains the propellant, for example sodium azide, potassium nitrate and sand pressed into tablet form. During the ignition process said propellant is ignited by the gas which escapes explosively from the ignition device 38 and in turn releases propellant gases which flow to the outside through the channels 50 and inflate an airbag which is attached, for example on the mounting ring 51.

Figure 10:
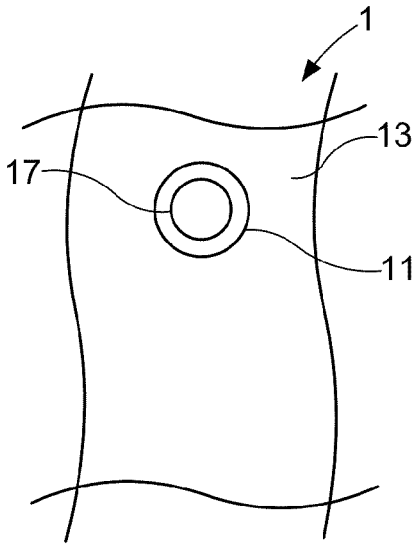
FIG. 10 shows schematically the front side of the metal-sealing material-feedthrough according to FIG. 2 with a circular cross-section.
Figure 11:
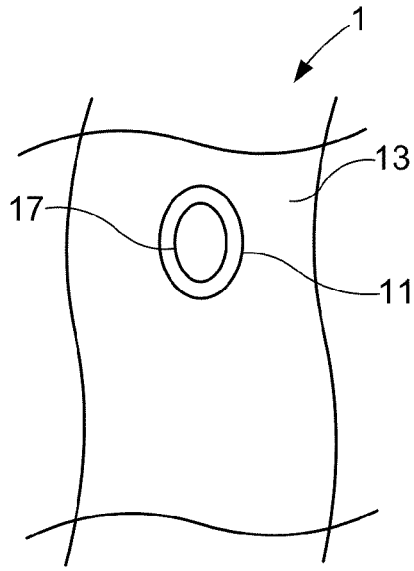
FIG. 11 shows schematically the front side of the metal-sealing material-feedthrough according to FIG. 2 with an oval cross-section.
Figure 12:
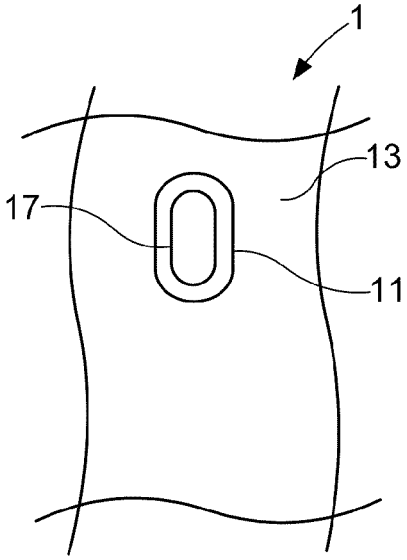
FIG. 12 shows schematically the front side of the metal-sealing material-feedthrough according to FIG. 2 with an elliptical cross-section.

FIG. 10 shows front side 13 of metal-sealing material-feedthrough 11 with a circular cross-section, as well as second partial section 17. FIG. 11 shows front side 13 of metal-sealing material-feedthrough 11 with an oval cross-section, as well as second partial section 17. FIG. 12 shows front side 13 of metal-sealing material-feedthrough 11 with an elliptical cross-section, as well as second partial section 17.

In all design examples illustrated in FIGS. 1*a* through 9, at least the feedthrough opening, or the entire base body, can be punched components. The individual measures taken in order to avoid a separation of the metal pin 4 from the base body under load which are depicted in the individual drawings on the base body 3, as well as the measures taken to avoid pulling the metal pin from the sealing material as provided on the metal pin, may also be applied together in combination. There are no limitations on the design in this regard. However, designs are strived for which assure great strength of the entire connection between the metal pin 4 and the base body 3 and thereby the metal-sealing material-feedthrough 1.

In all designs depicted in the drawings the feedthrough openings may be designed as having different cross sectional profiles, including circular cross sections. The formation of the undercuts occurs as an integral component of the base body.

The present invention provides the ratio the thickness of the punched component must be to the hole diameter in order to be able to fabricate a metal-sealing material-feedthrough as a punched component, and especially the feedthrough opening by way of punching.

COMPONENT IDENTIFICATION

1 Metal-Sealing material feedthrough
2 Metal collar
3 Base body
4 Metal pin
5 Metal pin
6 Glass slug
7 First face
8 Second face
9 Punched element
10 Outside circumference
11 Feedthrough opening
12 Back side
13 Front side
14 Outside circumference
15 Inside circumference
16 First partial section
17 Second partial section
20 First partial section
21 Second partial section
22 Third partial section
23 Protrusion
24 Surface
25 Surface
26 Pin retainer
27 Sleeve of base body
28 Inside wall surface of sleeve
29 Bridge
30 Transition point
31 Protrusion
32 Outside circumference
33 Fluting
34 Sealing material
35 Way/structure to prevent relative movement between sealing material and inside circumference of feedthrough opening
36 Undercut
37 Protrusion
38 Ignition device
39 Cap
40 Propellant
41 Laser weld seam
42 Housing
43 Bridge
44 Stop
45 Gas generator
46 Hollow space
47 Flange
48 Channel
49 Propellant container
50 Channel
51 Mounting ring
52 Plug which is inserted into sleeve
$D_1$ Diameter
$D_2$ Diameter
$L_{d1}$ Length
$L_{d2}$ Length

What is claimed is:

1. An igniter metal-sealing material-feedthrough for one of an air bag and a belt tensioning device, comprising:

a base body including a feedthrough opening formed by punching, a front side, and a back side, said base body being configured such that a ratio of a thickness of said base body to a maximum dimension of said feedthrough opening vertical to an axis direction of said feedthrough opening is in a range of between and including approximately 0.8 to 1.6, said thickness of said base body being between 1.8 mm and 3.0 mm;

a sealing material, said sealing material being one of a glass slug, a ceramics slug, and a glass-ceramic slug;

at least one first metal pin which is located in said feedthrough opening in said base body in said sealing material; and said feedthrough opening including a structure between said front side and said back side, said structure being configured for avoiding a relative movement of said sealing material in a direction toward said back side relative to an inside circumference of said feedthrough opening.

2. The igniter metal-sealing material-feedthrough in accordance with claim 1, wherein said ratio is in a range of between and including approximately 0.9 to 1.6.

3. The igniter metal-sealing material-feedthrough in accordance with claim 1, wherein said ratio is in a range of between and including approximately 0.9 to 1.4.

4. The igniter metal-sealing material-feedthrough in accordance with claim 1, wherein said ratio is in a range of between and including approximately 0.9 to 1.3.

5. The igniter metal-sealing material-feedthrough in accordance with claim 1, wherein said ratio is in a range of between and including approximately 1.0 to 1.2.

6. The igniter metal-sealing material-feedthrough in accordance with claim 1, wherein said thickness of said base body is between 1.5 mm and 3.1 mm.

7. The igniter metal-sealing material-feedthrough in accordance with claim 1, wherein said thickness of said base body is between 1.8 mm to 3.0 mm.

8. The igniter metal-sealing material-feedthrough in accordance with claim 1, wherein said thickness of said base body is between 2.0 mm to 2.6 mm.

9. The igniter metal-sealing material-feedthrough in accordance with claim 1, wherein said feedthrough opening has a circular cross section.

10. The igniter metal-sealing material feedthrough in accordance with claim 9, wherein one of a largest possible dimension and diameter of said feedthrough opening is in a range of 1.88 mm to 2.19 mm.

11. The igniter metal-sealing material-feedthrough in accordance with claim 1, wherein said feedthrough opening has an oval cross section.

12. The igniter metal-sealing material-feedthrough in accordance with claim 1, wherein said feedthrough opening has an elliptical cross section.

13. The igniter metal-sealing material-feedthrough in accordance with claim 1, wherein said base body with said feedthrough opening is in a form of a punched component.

14. The igniter metal-sealing material-feedthrough in accordance with claim 13, wherein said punched component is a ground.

15. The igniter metal-sealing material-feedthrough in accordance with claim 1, wherein said structure is one of an integral component of said base body and a structural unit with said base body.

16. The igniter metal-sealing material-feedthrough in accordance with claim 1, wherein said structure includes at least one undercut on said inside circumference of said feedthrough opening in said base body between said back side and said front side, said at least one undercut originating from said back side.

17. The igniter metal-sealing material-feedthrough in accordance with claim 1, wherein said structure includes an element which is inserted into said feedthrough opening, at least one of said inside circumference of said feedthrough opening and an outside circumference of said element possesses a roughness of ≧10 μm.

18. The igniter metal-sealing material-feedthrough in accordance with claim 1, further comprising a second metal pin.

19. The igniter metal-sealing material-feedthrough in accordance with claim 18, wherein said at least one first metal pin and said second metal pin are located parallel to each other.

20. The igniter metal-sealing material-feedthrough in accordance with claim 18, wherein said second metal pin is a grounding pin and is ground at said back side of said base body.

21. The igniter metal-sealing material-feedthrough in accordance with claim 1, wherein said sealing material is formed as a sealing material slug, wherein said at least one first metal pin is connected firmly with said sealing material slug.

22. The igniter metal-sealing material-feedthrough in accordance with claim 21, wherein said at least one first metal pin is fused with said sealing material.

23. The igniter metal-sealing material-feedthrough in accordance with claim 1, wherein said sealing material includes said glass slug formed from one of a molten glass and a high performance polymer.

24. The igniter metal-sealing material-feedthrough in accordance with claim 1, wherein said base body is standard steel.

25. The igniter metal-sealing material-feedthrough in accordance with claim 1, wherein said structure includes at least one frictional connection between said sealing material and said feedthrough opening to avoid relative movement between said sealing material and said feedthrough opening.

26. The igniter metal-sealing material-feedthrough in accordance with claim 1, wherein said base body is a type of steel including one of X12CrMoS17, X5CrNi1810, XCrNiS189, X2CrNi1911, X12CrNi177, X5CrNiMo17-12-2, X6CrNiMoTi17-12-2, X6CrNiTi1810, X15CrNiSi25-20, X10CrNi1808, and X2CrNiMo17-12-2.

27. The igniter metal-sealing material-feedthrough in accordance with claim 1, wherein said structure is configured such that a hydrostatic pressure which must be applied to eject one of said glass slug, said ceramic slug, and said glass-ceramic slug from said feedthrough opening in said direction toward said back side is between 1500 bar and 2500 bar.

28. An ignition device for airbags, said ignition device comprising a metal-sealing material-feedthrough including:

a base body including a feedthrough opening formed by punching, a front side, and a back side, said base body being configured such that a ratio of a thickness of said base body to a maximum dimension of said feedthrough opening vertical to an axis direction of said feedthrough opening is in a range of between and including approximately 0.8 to 1.6, said thickness of said base body being between 1.8 mm and 3.0 mm;

a sealing material, said sealing material being one of a glass slug, a ceramics slug, and a glass-ceramic slug;

at least one first metal pin which is located in said feedthrough opening in said base body in said sealing material; and said feedthrough opening included a structure between said front side and said back side, said structure being configured for avoiding a relative movement of said sealing material in a direction toward said back side relative to an inside circumference of said feedthrough opening.

29. An ignition device for belt tensioning devices, said ignition device comprising a metal-sealing material-feedthrough including:

a base body including a feedthrough opening formed by punching, a front side, and a back side, said base body being configured such that a ratio of a thickness of said base body to a maximum dimension of said feedthrough opening vertical to an axis direction of said feedthrough opening is in a range of between and including approximately 0.8 to 1.6, said thickness of said base body being between 1.8 mm and 3.0 mm;

a sealing material, said sealing material being one of a glass slug, a ceramics slug, and a glass-ceramic slug;

at least one first metal pin which is located in said feedthrough opening in said base body in said sealing material; and said feedthrough opening including a structure between said front side and said back side, said structure being configured for avoiding a relative movement of said sealing material in a direction toward said back side relative to an inside circumference of said feedthrough opening.

* * * * *